US011359429B2

(12) United States Patent
Pujol Oller et al.

(10) Patent No.: US 11,359,429 B2
(45) Date of Patent: Jun. 14, 2022

(54) SYSTEM FOR CLOSING AND OPENING AT LEAST ONE LEAF OF AN INWARD SWINGING DOOR

(71) Applicant: MASATS, S.A., Sant Salvador de Guardiola (ES)

(72) Inventors: Jordi Pujol Oller, Sant Salvador De Guardiola (ES); Jordi Freixa Ortiz, Sant Salvador De Guardiola (ES); Frederic Sole Montoya, Sant Salvador De Guardiola (ES); Eduard Sisquella Vila, Sant Salvador De Guardiola (ES)

(73) Assignee: MASATS, S.A., Sant Salvador de Guardiola (ES)

( * ) Notice: Subject to any disclaimer, the term of this patent is extended or adjusted under 35 U.S.C. 154(b) by 128 days.

(21) Appl. No.: 16/649,378

(22) PCT Filed: Sep. 21, 2018

(86) PCT No.: PCT/ES2018/070611
§ 371 (c)(1),
(2) Date: Mar. 20, 2020

(87) PCT Pub. No.: WO2019/058013
PCT Pub. Date: Mar. 28, 2019

(65) Prior Publication Data

US 2020/0248494 A1 Aug. 6, 2020

(30) Foreign Application Priority Data

Sep. 22, 2017 (EP) ..... 17382634

(51) Int. Cl.
*E05F 15/00* (2015.01)
*E05F 15/627* (2015.01)
(Continued)

(52) U.S. Cl.
CPC ..... *E05F 15/627* (2015.01); *E05D 15/30* (2013.01); *E05F 15/63* (2015.01);
(Continued)

(58) Field of Classification Search
CPC ..... E05D 15/30; E05F 15/627; E05F 15/63; E05Y 2900/51
See application file for complete search history.

(56) References Cited

U.S. PATENT DOCUMENTS 4,237,655 A * 12/1980 Yamao ..... E05D 15/30 49/252
4,282,686 A * 8/1981 Britzke ..... E05F 15/54 49/253
(Continued)

FOREIGN PATENT DOCUMENTS

| | | |
|---|---|---|
| CN | 106761134 A | 5/2017 |
| EP | 0 536 528 A1 | 4/1993 |
| ES | 2 344 333 A1 | 8/2010 |

OTHER PUBLICATIONS

International Search Report for PCT/ES2018/070611 dated Feb. 14, 2019 [PCT/ISA/210].
Written Opinion for PCT/ES2018/070611 dated Feb. 14, 2019 [PCT/ISA/237].

*Primary Examiner* — Daniel J Troy
*Assistant Examiner* — Daniel Alvarez
(74) *Attorney, Agent, or Firm* — Sughrue Mion, PLLC

(57) ABSTRACT

The system comprises a lever (2) that is rotatable about a point fixed to the vehicle and articulately joined to the upper edge (6) of the leaf (1); a horizontal guide (3) through which a carriage (4) slides; push-pull means (10,11) that articulately link the upper edge (6) to the carriage (4); and actuation means (12) simultaneously linked to the lever (2) and the carriage (4), which are adapted to distribute their action on the lever (2) and the carriage (4) depending on the force to overcome in order to open and close the leaf (1),
(Continued)

such that their action is automatically distributed on the lever (2) when greater power is required to move the carriage (4), this is essentially during the initial opening operation from the end closing position, and during the closing and locking operation from an imminent closing position.

11 Claims, 6 Drawing Sheets

(51) Int. Cl.
*E05F 15/63* (2015.01)
*E05D 15/30* (2006.01)

(52) U.S. Cl.
CPC ..... *E05Y 2900/506* (2013.01); *E05Y 2900/51* (2013.01); *E05Y 2900/531* (2013.01)

(56) References Cited

U.S. PATENT DOCUMENTS

| | | | | |
|---|---|---|---|---|
| 4,375,140 | A * | 3/1983 | Blair | E05F 17/004 49/108 |
| 4,433,505 | A * | 2/1984 | Viner | E05D 15/1044 49/110 |
| 2017/0158305 | A1* | 6/2017 | Werthmann | E05D 15/54 |
| 2018/0010375 | A1* | 1/2018 | Sauter | E05F 5/027 |
| 2021/0180380 | A1* | 6/2021 | Lygin | E05F 1/00 |

* cited by examiner

SYSTEM FOR CLOSING AND OPENING AT LEAST ONE LEAF OF AN INWARD SWINGING DOOR

CROSS REFERENCE TO RELATED APPLICATIONS

This application is a National Stage of International Application No. PCT/ES2018/070611 filed Sep. 21, 2018, claiming priority based on European Patent Application No. 17382634.8 filed Sep. 22, 2017.

TECHNICAL FIELD OF THE INVENTION

The invention relates to a system for closing and opening at least one leaf of an inward swinging door, which is particularly applicable to doors of passenger transport vehicles such as buses, trains, etc.

BACKGROUND OF THE INVENTION

Currently several types of mechanisms for closing and opening the leaf or leaves of a door are known, which are particularly applicable to passenger transport vehicles such as buses, coaches and trains. Examples of said types are sliding doors which are also known as swinging-sliding doors, inward swinging doors and outward swinging doors.

Specifically, an inward swinging door is understood as that with a leaf having a guide device arranged close to the main side edge thereof (in doors with two leaves, that which is oriented towards the side of the other leaf). This device is forced to move through a fixed track or a bar arranged in the upright of the door. A vertical shaft of the door is connected to the upper and/or lower portion of the door leaf close to the side outer edge (that which is opposite the main side edge) by means of arms and bearings that end at the aforementioned bar.

When the main motor makes the shaft of the door rotate, the outer edge of the door is taken towards the inside of the vehicle, while the guide device forces the main edge to move towards the door jamb in the opening position. In the opening position, the door leaf is perpendicular to the side of the vehicle and as close as possible to the jamb. The main edge of the door leaf may project beyond the side of the vehicle in the opening position. Thus, when changing from the closing position to the opening position, the corners of the main side edge describe an essentially curved path while the corners of the side outer edge describe a path essentially perpendicular to the side of the vehicle where said door is located.

Patent ES2344333, from the same applicant as the present application, describes a system for closing and opening of at least one leaf of an inward swinging door, especially doors of passenger transport vehicles. This system comprises a drive lever, which is rotatable on a horizontal plane about a first end on a point fixed to the vehicle, and which describes alternate angular opening and closing movements of the door towards and from the inside of the vehicle, respectively, the second end of the lever being articulately joined to a first sector of the upper edge of the door leaf. This system also comprises a horizontal support guide arranged below the lintel of the housing compartment for the door provided in the body, and through which a carriage slides in a rectilinear and alternate back-and-forth movement for closing and opening the door; and also push-pull means formed by two arms articulated therebetween, of which one arm is coupled to a second sector of the upper edge of the leaf, and the other arm is coupled to the carriage, such that when the leaf is rotated between two end resting positions that correspond to the opening and closing positions of the door, due to the effect of the drive lever, said push-pull means force said second sector of the upper edge of the leaf to describe a path guided during the opening and closing of the door.

In practice, the drive lever of this type of system tends to be fixedly joined by the first end thereof to an essentially vertical bar that rotates about the axial shaft thereof, the upper and lower ends of which are points fixed to the vehicle, whereby the drive lever rotates jointly with said vertical bar. Currently, both electric and pneumatic actuation means are used to rotate the bar.

However, this type of system has the drawback that it is not possible to have effective control over the speed of the leaf when it opens and closes due to the geometry of the system mechanisms. It must be noted that the control of speed is more critical in a position close to the opening position, that is, in the final opening phase or in the initial closing phase, since the multiplier effect of the movement entails that a small rotation of the vertical bar generates a large path of the lever and, therefore, a large translation of the leaf, causing unwanted sudden movements on the leaf.

This problem is compounded in situations in which the vehicle is on sloping ground, especially slopes greater than 20 degrees, since the pneumatic actuator or electric motor must operate at a higher power in order to overcome the overload generated on the system due to the effect of gravitational force, which causes the generation of excessively sudden movements during opening and closing operations of the door leaf, with the risk of possible faults in the system due to excess stress on the components thereof.

With regards to the electrical actuation systems, which usually use an electric motor and a gear system, it must be noted that to ensure a low rotation speed of the bar, a high ratio is required in the gear system. However, the high ratio entails having considerable give in the transmission of the movement from the drive portion to the door leaf, causing an ineffective control of the movement. In this case, the high ratio causes the system to be irreversible, which means that a decoupling system must be added to the door in case of emergency. Therefore, as the system is irreversible, all the external stresses exerted on the door leaf are transmitted to the motor, which entails oversizing the entire system to absorb the undesired stresses.

Moreover, in pneumatic actuation systems, which use a pneumatic cylinder that actuates on the bar, it is important to note that the geometry itself of the system and the aforementioned multiplying effect entail having ineffective control of the movement of the leaf. In addition, the effective closing force directly depends on the supply of air pressure, which is not always stable. Therefore, the security of the closing position depends entirely on the pneumatic cylinders and the supply of air, which means that any failure in these elements entails that the door remains open. Likewise, the stress controls in both opening and closing directions imply a high level of sophistication in the control and actuation system, which entails an increase in the manufacturing and maintenance costs.

The fact that the force required to maintain the leaf locked in the end closing position depends directly on the actuation means, whether by means of a pneumatic actuator or an electric motor, entails that this type of system is essentially vulnerable to acts of anti-social behaviour or vandalism by people who intend to force the door from the outside in order to gain unauthorised access to the inside of the vehicle.

Document CN10676113 A discloses a system for closing and opening two leaves of an inward swinging door for passenger vehicles, which comprises a swinging mechanism and a transmission mechanism. The swinging mechanism includes, for each leaf, a lever which is rotatable on a horizontal plane about a first end on a point fixed to the vehicle and the second end of the lever being articulately joined to the upper edge of the leaf, a horizontal guide through which a carriage slides, and push-pull means which link the upper edge of the leaf to the carriage. The transmission mechanism includes an electric motor connected to a differential, an upper wheel and a lower wheel respectively connected to the differential, a first transmission belt coupled to the upper wheel and configured to drive two pulleys respectively connected to the rotatable shafts of the levers of both leaves, and a second transmission belt coupled to the lower wheel and configured to drive simultaneously the respective carriages of both leaves. The upper wheel and the lower wheel output different rotational speeds to coordinate the rotational movement of the levers and the sliding movement of the carriages. However, a differential is a complex mechanism and difficult to be incorporated in this type of system which requires components of small size.

Document EP0536528 A1 refers to a device for operating a swinging-sliding door for passenger vehicles, in particular for rail vehicles, whose door leaf is displaceable in its longitudinal direction along a guide element which, as part of a four-bar linkage, is movable at right angles to the plane of the door leaf. The longitudinal movement of the door leaf being coordinated with the transverse movement by means of a guide rail, which is firmly connected to the door frame and into which a guide means firmly connected to the door leaf engages, and in which the output power of a drive device on the door frame acts in the direction of the guide element. The reaction force of the drive device exerts a torque upon a spreader element disposed between the guide element and a supporting part connected to the door frame, which torque effects a force acting in a direction substantially normal to the guide element upon said guide element in order to generate the transverse movement. The drive device comprises an electric motor with load-side gearing, whose housing is mounted rotatably about a vertical axis on the guide element and whose output shaft drives a chain or belt transmission, which is disposed parallel to the guide element and to which the door leaf is coupled, and the spreader element takes the form of a spreader lever which is firmly connected to the motor gearbox and is supported via a guide roller on a rail firmly connected to the door frame. However, this device is directed to operating a swinging-sliding door, but it is not suitable for operating an inward swinging door.

It would be desirable to have a system capable of achieving optimal control of the speed of the door leaf during its opening and closing path, preventing any sudden movement.

It would also be desirable to have a system that guarantees an effective locking of the leaf in the end closing position thereof, in order to prevent the leaf from remaining open when there is a possible failure in the operation of the actuation means, as well as making it impossible to force the leaf open from the outside or inside of the vehicle.

It is also of interest for the solution to be able to be mechanically implemented in a simple way, with few components in order to avoid an increase in manufacturing costs, as well as avoid high repair and maintenance costs.

DESCRIPTION OF THE INVENTION

For the purpose of providing a solution to the problems proposed, a system is disclosed for closing and opening at least one leaf of an inward swinging door, which is particularly applicable to doors of passenger transport vehicles, the system comprising:

- a lever which is rotatable on a horizontal plane about a first end on a point fixed to the vehicle, and which describes alternate angular opening and closing movements of the door towards and from the inside of the vehicle, respectively, the second end of the lever being articulately joined to a first sector of the upper edge of the door leaf;
- a horizontal guide, located above the upper edge of the door leaf, through which a carriage slides in a rectilinear and alternate back-and-forth movement for closing and opening the door, said guide being integral to a longitudinal support mounted on the lintel of the housing compartment for the door provided in the body of the vehicle; and
- push-pull means that link a second sector of the upper edge to the carriage by means of an articulated joint, arranged such that when the leaf rotates between two end resting positions that correspond to the opening and closing positions of the door, due to the effect of the lever, said push-pull means force said second sector of the upper edge of the leaf to describe a guided path during the opening and closing of the door, the lever and push-pull means being arranged such that when the door leaf is in the end opening position, the vertical plane that makes up the door leaf is essentially perpendicular to the vertical plane that defines the housing compartment for the door, the leaf remaining inside the vehicle.

The system is characterised in that it comprises actuation means simultaneously linked to the lever and the carriage, which are adapted to distribute their action on the lever and the carriage depending on the force to overcome in order to open and close the leaf, such that by default the actuation means are adapted to act on the carriage during the opening and closing path of the leaf, automatically distributing its action on the lever when greater power is required to move the carriage, this is essentially during the initial opening operation of the leaf from the end closing position, and during the closing and locking operation of the leaf from an imminent closing position.

In this way, thanks to the fact that the actuation means can act interchangeably on the carriage or on the lever, depending on the force to overcome in order to carry out the opening and closing of the leaf, an optimal control of the speed of the door leaf is achieved, which provides uniformity to the movement of the leaf during the entire opening and closing path thereof, without sudden movements, unlike the case of the systems known in the state of the art in which the lever was the only drive element. Moreover, an effective closing and locking of the leaf in the end closing position thereof is guaranteed.

Advantageously, the actuation means comprise an electric motor coupled to said longitudinal support, the rotor and stator of which are arranged to be able to rotate mutually with each other; the rotor being coupled to a first transmission mechanism that promotes the alternate back-and-forth movement of the carriage to open and close the leaf, in this case the lever being driven; and the stator being coupled to a second transmission mechanism that promotes the rotation movement of the lever, in this case the carriage being driven, such that the stator is susceptible to rotate when the rotor brakes as it is not able to transmit to the carriage the force required to lock or unlock the leaf in the closing position.

In this way, it is not the action of the motor that keeps the leaf locked in the end closing position, but rather said action is achieved by means of the second mechanism that, due to the geometry thereof, enables the system to be locked, thereby releasing the motor from overexertion, unlike in the case of the systems known in the state of the art in which the motor or the pneumatic actuator acts on the lever to maintain the leaf closed.

Therefore, due to the system of the invention, the following advantages are achieved:

- Maintaining the door closed under any load, which makes it impossible to force the leaf open from the inside or outside of the vehicle, for example, due to acts of anti-social behaviour or vandalism.
- Releasing the motor from external overexertion on the system.
- Ensuring the door mechanically closes with the involvement of few elements.
- Maintaining the door closed under any energy supply conditions, or when there is a possible failure in the operation of the motor.
- Maintaining the uniformity of the movement throughout the path, as mentioned above.
- Greater operation capacity in any position of the door leaf, especially when the vehicle is on sloping ground.

Preferably, the motor is fastened to the longitudinal support in an area close to the main side edge of the leaf that is opposite the first rotation end of the lever. In this case, in doors with two leaves, both motors are placed adjacent to each other in a central area of the longitudinal support.

Alternatively, other possible arrangements could be envisioned for locating the motor; for example, the motor for each leaf could be placed on both side ends of the longitudinal support, in order to provide more space for housing other external elements, such as an emergency system for opening the door.

In accordance with another characteristic of the invention, said first mechanism comprises a transmission belt coupled to the carriage and mounted in a closed loop around a driving pulley that rotates jointly with the shaft of the rotor and a set of driven pulleys that are integral to said longitudinal support, such that the transmission belt defines a rectilinear path for the movement of the carriage on the horizontal guide according to a linear back-and-forth movement to open or close the leaf depending on the rotation direction of the rotor.

Preferably, the set of driven pulleys comprises at least one pulley arranged at opposite ends corresponding to the start and end of the path of the carriage, and at least one idler pulley that, in combination with the driving pulley, enables the transmission belt to be arranged according to two essentially parallel branches, the carriage being coupled to one of said branches.

According to another characteristic of the invention, said second mechanism is a crankshaft-rod mechanism comprising a rotating platform that rotates jointly with the stator, and a transmission connecting rod articulately joined by a first end to an eccentric point of the rotating platform and by the second end thereof to a first end of a thrust arm, said thrust arm in turn being articulately joined by the other end thereof to the aforementioned first rotation end of the lever that pivots about a point fixed to the vehicle, to open or close the leaf depending on the rotation direction of the stator.

Advantageously, in the closing and locking position of the leaf, the two articulation shafts of both ends of the connecting rod are arranged diametrically opposite one another with respect to the rotation shaft of the stator, and preferably with the shaft of the first end of the connecting rod arranged in a position that extends beyond the rotation shaft of the stator, such that the imaginary line that joins the shafts of both ends of the connecting rod is out of phase at a predetermined distance with respect to the position of said rotation shaft of the stator.

This geometric arrangement guarantees an optimal effectiveness in locking the system in the end closing position of the leaf, enabling possible vibrations or deformations of the system itself to be covered.

Preferably, the motor is mounted such that the rotor projects from the lower portion of the longitudinal support, on the surface of which there is the horizontal guide of the carriage, and such that the stator projects from the upper portion of the longitudinal support. In this way, the two transmission mechanisms are each placed on one side of the longitudinal support, which makes the system more compact.

Alternatively, other possible arrangements could be envisaged, for example, arranging the rotor and the stator on the same side of the longitudinal support, either on the upper or lower portion thereof, depending on the space available.

According to another characteristic of the invention, the first rotation end of the lever is securely attached to an essentially vertical bar that rotates about the axial shaft thereof and the upper and lower ends of which are points fixed to the vehicle.

Preferably, the push-pull means comprise an arm securely joined by an end to the second sector of the upper edge of the leaf, and articulately joined at the other end thereof to a vertical rod integral to the carriage, about which it may rotate.

In accordance with another characteristic of the invention, the horizontal guide is made up of an open transverse cross section profile defining a groove, and the carriage comprises at least one caster with a vertical shaft that circulates inside said groove.

According to a preferred embodiment of the invention, a system for closing and opening the two leaves of an inward swinging door is disclosed, particularly for doors of passenger transport vehicles, comprising two systems as described above, arranged symmetrically and one for each leaf, the horizontal guides of which are integrated in the same longitudinal support.

BRIEF DESCRIPTION OF THE DRAWINGS

The attached drawings illustrate by way of non-limiting example, a preferred embodiment of the system for closing and opening at least one leaf of an inward swinging door. In said drawings.

DETAILED DESCRIPTION OF AN EMBODIMENT

Figure 1:
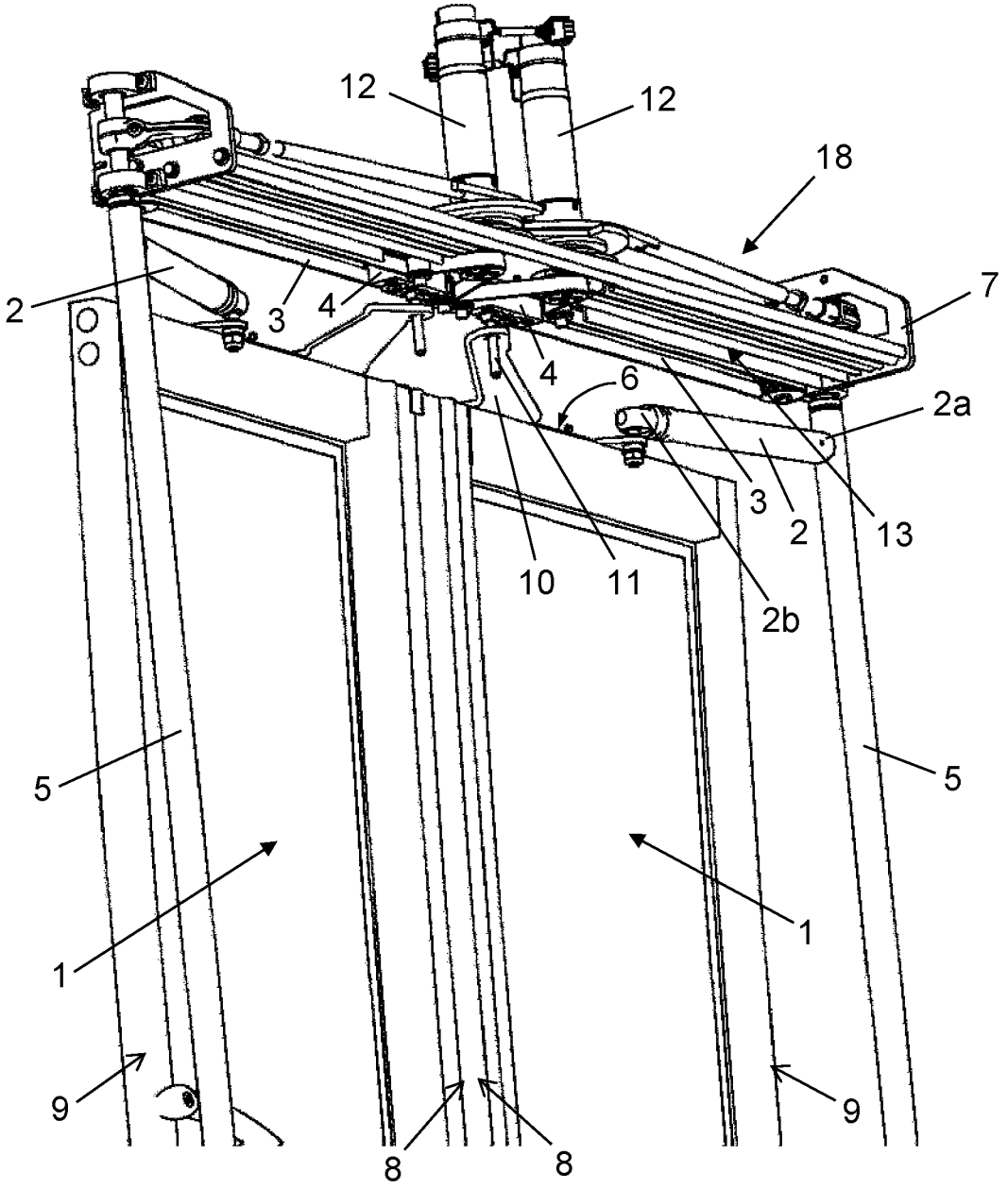
FIGS. 1 and 2 are perspective views of the system according to a preferred embodiment of the invention, seen from the inside of the vehicle, and applied to an inward swinging door with two leaves, wherein the door is in the end closing position and in an intermediate opening position, respectively.

FIG. 1 partially represents an inward swinging door with two leaves 1, for use in passenger transport vehicles, such as buses, coaches, trains, etc., in the end closing position. In addition, the system for closing and opening each leaf 1 is shown, according to a preferred embodiment of the invention.

Figure 2:
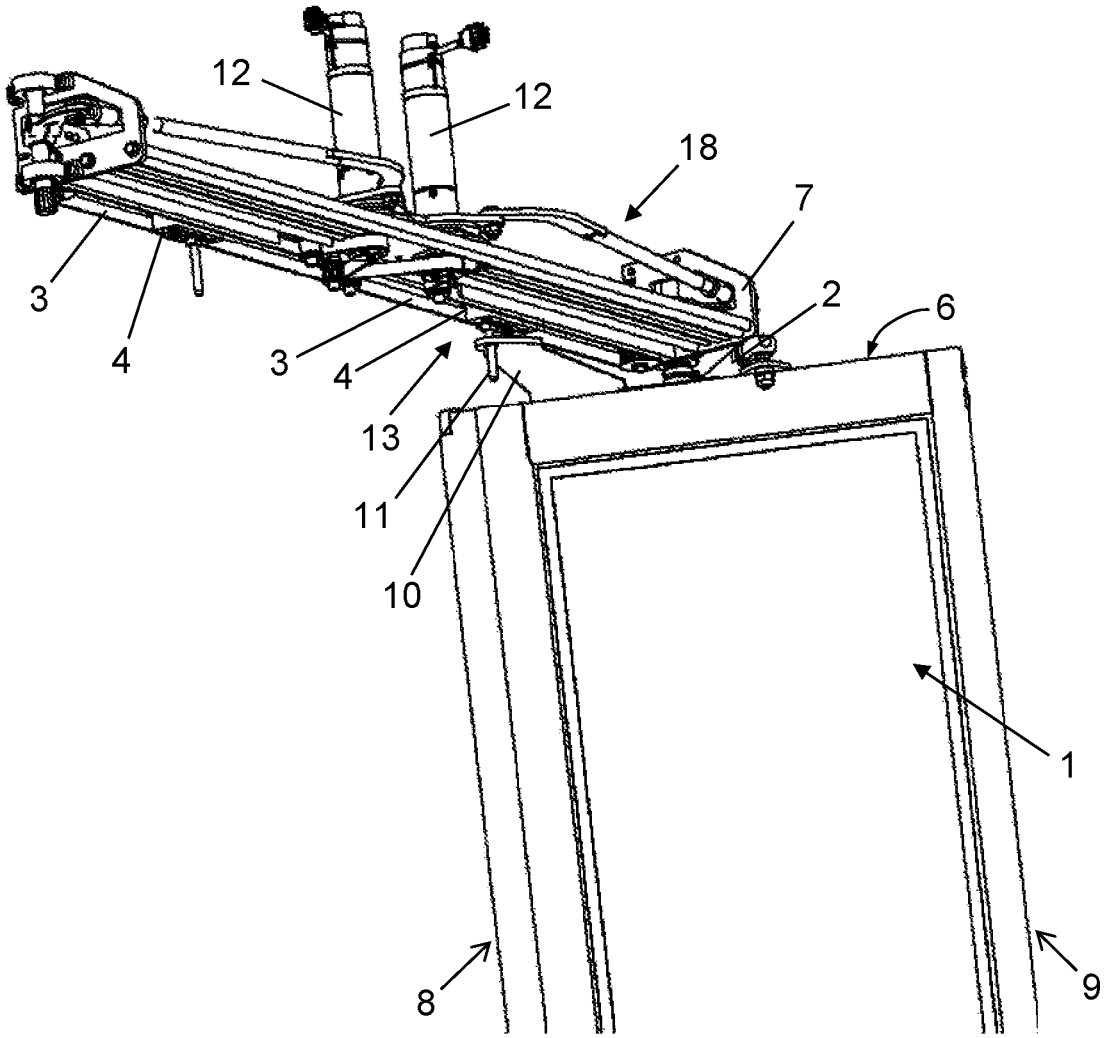

FIG. 2 shows the door in an intermediate opening position, wherein a single leaf 1 has been illustrated to improve clarity.

The system for closing and opening each leaf 1 of the inward swinging door basically comprises a rotating lever 2, a horizontal guide 3 through which a carriage 4 slides, push-pull means 10,11 and actuation means 12, as shall be explained below.

As shown in the preferred embodiment of FIGS. 1 to 5, two systems according to the invention are used, which are arranged symmetrically and one for each leaf 1 of the door. During the opening movement of the door, the carriages 4 slide along the respective horizontal guides 3 thereof, moving away from each other, while during the closing movement, the carriages 4 slide in the direction opposite to that of the previous direction, moving closer to each other.

To improve clarity, the system of the invention shall be described hereafter by only referring to one of the leaves 1.

The aforementioned lever 2 is rotational on a horizontal plane about a first end 2*a* on a point fixed to the vehicle, such as for example the floor of the vehicle, the inner face of the body or the inner face of the upright of the door opening. In this preferred embodiment, the first end 2*a* of the lever 2 is securely attached to an essentially vertical bar 5 that rotates about the axial shaft thereof and the upper and lower ends of which are points fixed to the vehicle.

The lever 2, due to rotating integrally with the bar 5, describes alternate angular opening and closing movements of the door towards the inside of the vehicle and towards the outside thereof, respectively. To do so, the second end 2*b* of the lever 2 is articulately joined to a first sector of the upper edge 6 of the door leaf 1 and describes a curved path with the first end 2*a* as the centre.

The aforementioned horizontal guide 3 is located above the upper edge 6 of the door leaf 1 and just below the lintel of the housing compartment for the door provided in the body of the vehicle, the horizontal guide 3 being integral to a longitudinal support 7 mounted on said lintel. The respective carriage 4 slides along the horizontal guide 3 in a rectilinear and alternate back-and-forth movement to close and open the door. In the embodiment of FIGS. 1 to 5, the respective horizontal guides 3 of both leaves 1 are integrated in a same longitudinal support 7.

Figure 6A:
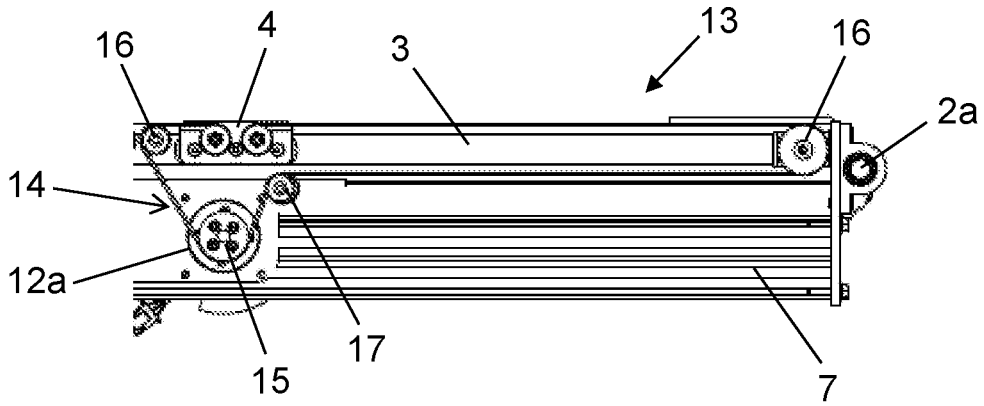
FIGS. 6*a*, 6*b* and 6*c* show a sequence of the movement of the first pulleys and transmission belt mechanism linked to a door leaf, in the end closing position, in an intermediate position, and in the end opening position, respectively.
Figure 6B:
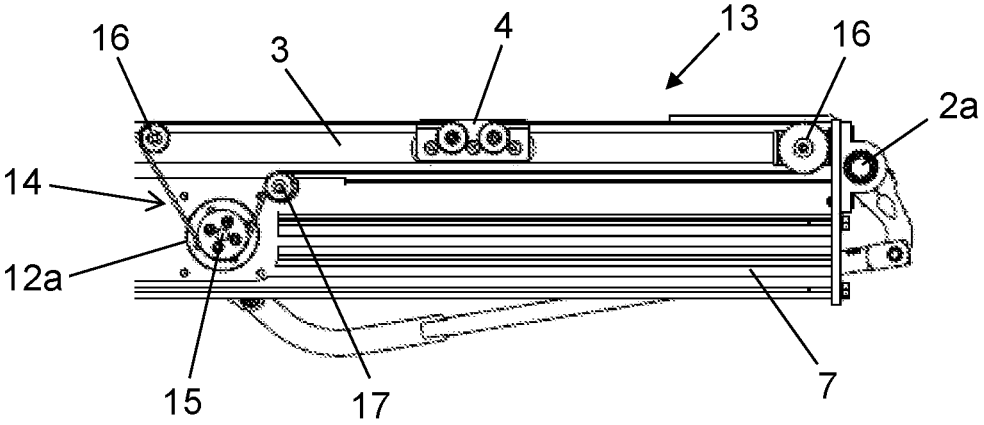
Figure 6C:
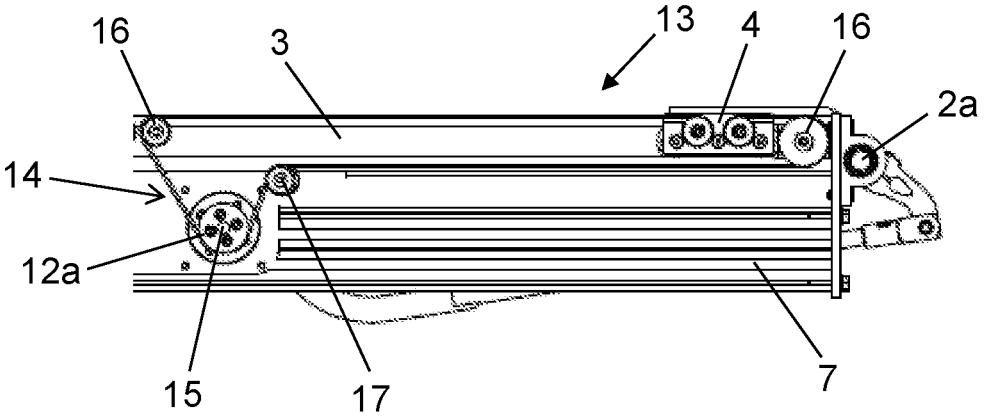

In FIGS. 1 and 6*a*, which show the end closing position, it can be seen that the carriage 4 is located at one end of the horizontal guide 3, close to the main side edge 8 of the leaf 1 (in doors with two leaves, that which is oriented towards the side of the other leaf); while FIGS. 2 and 6*b* show that the carriage 4 has moved towards an intermediate position, moving towards the opposite end of the horizontal guide 3, close to the side outer edge 9 of the leaf 1 (that which is opposite the main side edge 8) where the leaf 1 will reach the end opening position thereof (see FIG. 6*c*).

Carriage is understood as any piece equipped with a horizontal translation movement, which can be pads, casters, rollers, bearings, slider devices, etc.

Figure 4:
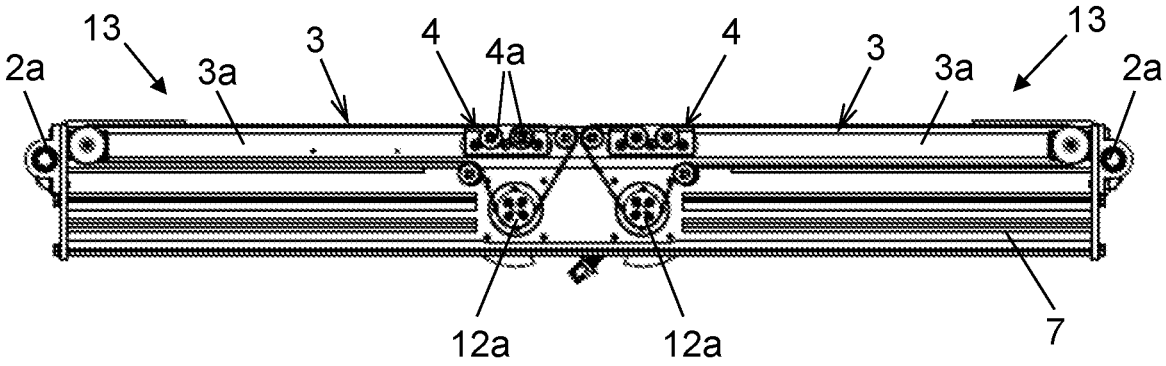

In the shown embodiment, the horizontal guide 3 is made up of an open transverse cross section profile that defines a groove 3*a*, and the carriage 4 comprises two casters 4*a* with vertical shafts that move through the inside and along said groove 3*a* (see FIG. 4).

The push-pull means link a second sector of the upper edge 6 to the carriage 4 by means of an articulated joint. According to the shown embodiment, said push-pull means are formed by an arm 10 securely joined at one end to the second sector of the upper edge 6 of the leaf 1, and articulately joined by the other end thereof to a vertical rod 11 integral to the carriage 4, about which it may rotate. In this way, when the leaf 1 rotates between two end resting positions that correspond to the opening and closing positions of the door, due to the effect of the lever 2, said push-pull means 10,11 force said second sector of the upper edge 6 of the leaf 1 to describe a guided path during the opening and closing of the door.

As a result, during the opening and closing movements, the ends of the main side edge 8 of the leaf 1 describe a curved path, while the ends of the side outer edge 9 describe a rectilinear path essentially perpendicular to the lintel of the door.

In addition, the lever 2 and push-pull means 10,11 are arranged such that when the door leaf 1 is in the end opening position, the vertical plane that makes up the door leaf 1 is essentially perpendicular to the vertical plane that defines the housing compartment for the door, the leaf 1 remaining inside the vehicle.

Figure 3:
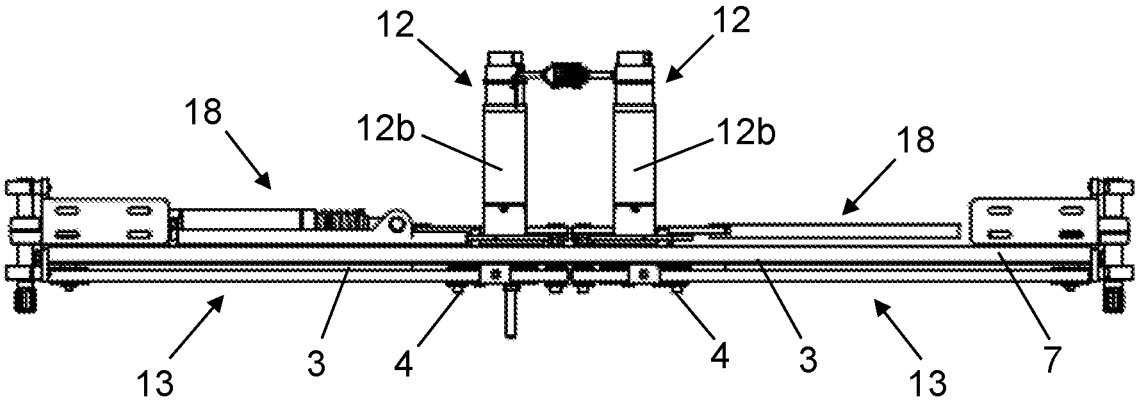
FIGS. 3, 4 and 5 respectively show elevation, lower plan and upper plan views of the system of the invention, in the end closing position of the door.
Figure 5:
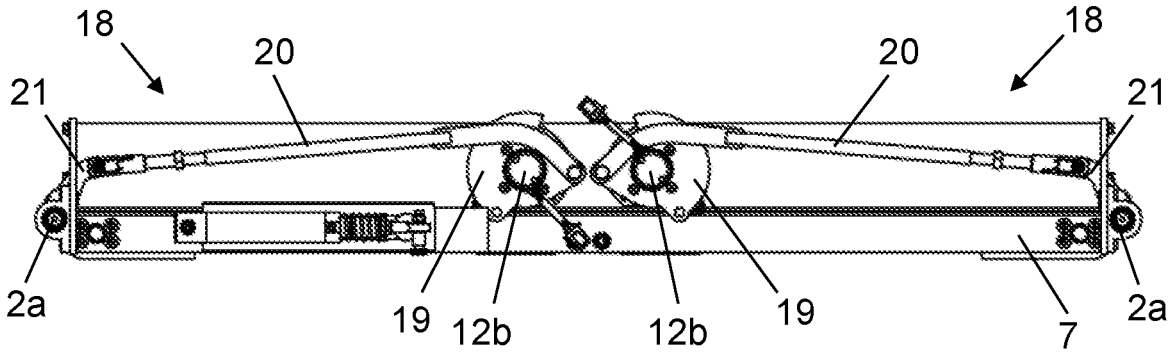

As can be seen, for example, in FIGS. 3 to 5, the actuation means comprise an electric motor 12 coupled to said longitudinal support 7, the rotor 12*a* and stator 12*b* of which are arranged to be able to rotate mutually with each other. The motor 12 is simultaneously linked to the lever 2 and the carriage 4, being capable of distributing the action thereof on the lever 2 and the carriage 4 depending on the force to overcome in order to open and close the leaf 1, as shall be explained below.

By default, the motor 12 acts on the carriage 4 during the opening and closing path of the leaf 1, distributing the action thereof on the lever 2 when a greater power is required to move the carriage 4, this is essentially during the initial opening operation of the leaf 1 from the end closing position, and during the closing and locking operation of the leaf 1 from an imminent closing position.

As can be seen in FIG. 4, the rotor 12*a* is coupled to a first transmission mechanism 13 that promotes the alternate back-and-forth movement of the carriage 4 for opening and closing the leaf 1, in this case the lever 2 being driven.

In this preferred embodiment (see FIGS. 4 and 6*a* to 6*c*), said first mechanism 13 comprises a transmission belt 14 coupled to the carriage 4 and mounted in a closed loop around a driving pulley 15 that rotates jointly with the shaft of the rotor 12*a* and a set of driven pulleys 16, 17 that are integral to said longitudinal support 7, such that the transmission belt 14 defines a rectilinear path for the movement of the carriage 4 on the horizontal guide 3 according to a linear back-and-forth movement to open or close the leaf 1 depending on the rotation direction of the rotor 12*a*.

In this example, the set of driven pulleys comprises a pulley 16 arranged at both opposite ends corresponding to the start and end of the path of the carriage 4, and an idler pulley 17 that, in combination with the driving pulley 15, enables the transmission belt 14 to be arranged according to two essentially parallel branches, the carriage 4 being coupled to one of said branches.

As can be seen in FIG. 5, the stator 12*b* is coupled to a second transmission mechanism 18 that promotes the rotation movement of the lever 2, in this case the carriage 4 being driven, such that the stator 12*b* is susceptible to rotate when the rotor 12*a* brakes as it is not able to transmit to the carriage 4 the force required to lock or unlock the leaf 1 in the closing position.

In this preferred embodiment (see FIGS. 5 and 7*a* to 7*c*), said second mechanism 18 is a crankshaft-rod mechanism comprising a rotating platform 19 that rotates jointly with the stator 12*b*, and a transmission rod 20 articulately joined by a first end 20*a* to an eccentric point of the rotating platform 19 and by the second end 20*b* thereof to a first end of a thrust arm 21, said thrust arm 21 in turn being articulately joined at the other end thereof to the aforementioned first rotation end 2*a* of the lever 2 that pivots about a point fixed to the vehicle, in this example about a bar 5, to open or close the leaf 1 depending on the rotation direction of the stator 12*b*.

Moreover, as can be seen in the embodiment of FIGS. 1 to 5, the motor 12 is fastened to the longitudinal support 7 in an area close to the main side edge 8 of the leaf 1, that is, opposite the edge where the first rotation end 2*a* of the lever is located. In this case, in doors with two leaves, both motors 12 are placed adjacent to each other in a central area of the longitudinal support 7.

Likewise, in the shown embodiment, the motor 12 is mounted such that the rotor 12*a* projects from the lower portion of the longitudinal support 7, on the surface of which there is a horizontal guide 3 of the carriage 4, and such that the stator 12*b* projects from the upper portion of the longitudinal support 7. In this way, the two transmission mechanisms 13 and 18 are each placed on one side of the longitudinal support 7, which makes the system more compact.

Figure 7A:
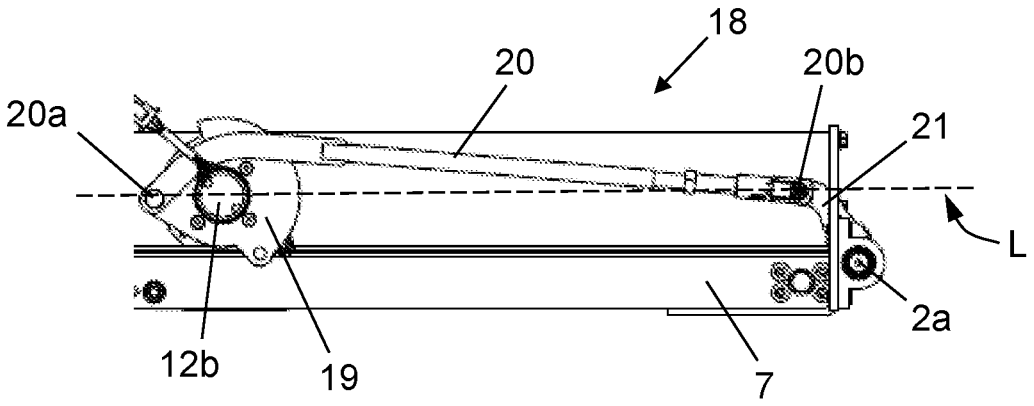
FIGS. 7*a*, 7*b* and 7*c* show a sequence of the movement of the second crankshaft-rod mechanism linked to a door leaf, in the end closing position, in an intermediate position, and in the end opening position, respectively.
Figure 7B:
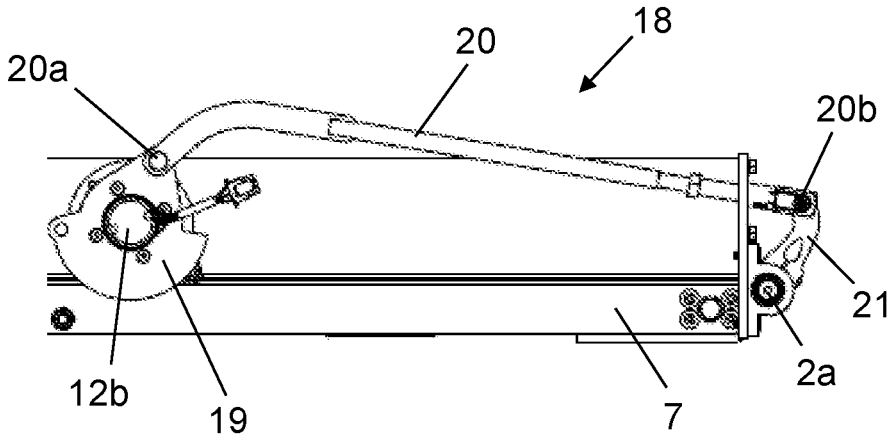
Figure 7C:
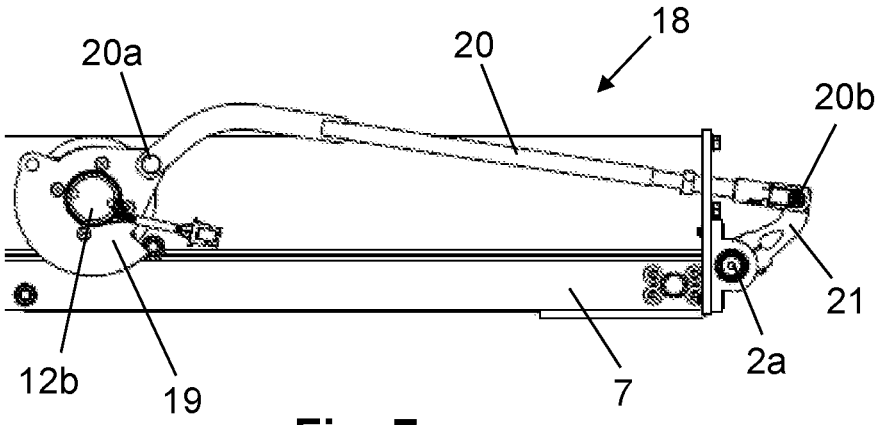

The sequence of movements of the first 13 and second 18 transmission mechanisms is shown in the respective FIGS. 6*a* and 7*a* (end closing position), FIGS. 6*b* and 7*b* (intermediate position), and FIGS. 6*c* and 7*c* (end opening position).

In order to open the leaf 1, from the end closing position (see FIGS. 6*a* and 7*a*), it is important to note that in this situation, the rotor 12*a* is not capable of providing the force necessary to move the carriage 4 by means of the first pulleys and transmission belt mechanism 13, so it brakes thus forcing the stator 12*b* to rotate. As a result, the stator 12*b* acts on the first crankshaft-rod mechanism 18.

The rotation of the stator 12*b* causes the rotation of the platform 19, which promotes the movement of the connecting rod 20 which in turn pushes the arm 21, the swivelling of which enables the rotation of the vertical bar 5, and thus the rotation of the lever 2 in the direction towards the inside of the vehicle. In this case, the lever 2 acts as a drive element, drawing from the upper edge 6 of the leaf 1, which in turn stretches the articulated arm 10 of the push-pull means, thus causing the carriage 4 to be pulled, enabling the opening of the leaf 1 to be initiated.

Once the movement of the carriage 4 has been initiated, the force necessary to maintain the movement of the carriage 4 reduces as a result of inertia, whereby the rotor 12*a* automatically starts to rotate, acting on the carriage 4 by means of said first pulleys and transmission belt mechanism 13. In turn, the stator 12*b* will stop acting.

The carriage 4, pulled by the transmission belt 14, moves along the horizontal guide 3 until it reaches the opposite end of the final limit switch corresponding to the end opening position of the leaf (see FIGS. 6*c* and 7*c*). In this case, the carriage 4 is the drive element, the movement of which causes the articulated arm 10 of the push-pull means to be pushed, which in turn transmits the movement to the lever 2. In this case, the lever 2 acts as a driven element, drawing the upper edge 6 of the leaf 1 until it is fully open.

Then, in order to close the door, from the end opening position (see FIGS. 6*c* and 7*c*) the rotor 12*a* continues to act on the carriage 4 by means of a first pulleys and transmission belt mechanism 13, but by rotating in the opposite direction in order to take the carriage 4 towards the initial limit switch of the horizontal guide 3 (see FIG. 6*a*). As a result, the lever 2 rotates in the opposite direction in order to push the upper edge 6 of the leaf 1, thus causing the door leaf to close.

In a position of the leaf 1 imminent to the closing position, the force that the rotor 12*a* must overcome in order to keep the carriage 4 moving increases, such that in this situation the rotor 12*a* is not capable of moving the carriage 4, which makes the stator 12*b* automatically start to rotate, acting on the first crankshaft-rod mechanism 18 causing the closing and locking of the leaf 1.

Figure 8:
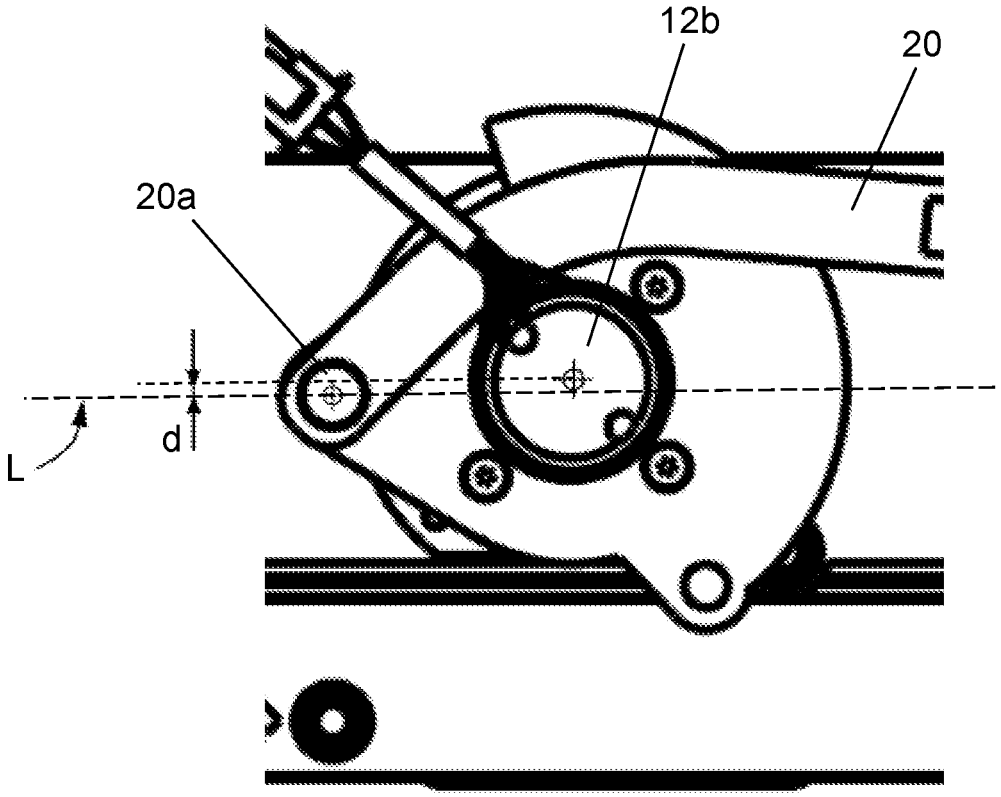
FIG. 8 is an expanded view of FIG. 7*a*, which shows that in the locking position of the door, the shaft of the first end of the connecting rod is arranged in a position that extends beyond the rotation shaft of the stator.

As can be seen in FIGS. 7*a* and 8, which show the end closing position, the second crankshaft-rod mechanism 18 adopts a geometry such that the two articulation shafts of both ends 20*a* and 20*b* of the connecting rod 20 are arranged diametrically opposite one another with respect to the rotation shaft of the stator 12*b*. Likewise, the shaft of the first end 20*a* of the connecting rod 20 is arranged in a position that extends beyond the rotation shaft of the stator 12*b*, such that the imaginary line L that joins the shafts of both ends 20*a* and 20*b* of the connecting rod 20 is out of phase at a predetermined distance d with respect to the position of said rotation shaft of the stator 12*b* (see FIG. 8). This arrangement causes the locking of said second mechanism 18, and therefore the locking of the door leaf 1.

Although said locking effect is in theory achieved by having both articulation shafts of the ends 20*a* and 20*b* of the connecting rod 20 aligned with the shaft of the stator 12*b*, it is important to note that said extended position of the first end 20*a* of the connecting rod 20 guarantees an optimal effectiveness in locking the system, enabling to cover possible vibrations or deformations of the system itself.

The invention claimed is:

1. A system for closing and opening a leaf (1) of an inward swinging door for a passenger transport vehicle, the system comprising:

a lever (2) which is rotatable on a horizontal plane about a first end (2*a*) on a point fixed to the vehicle, and which describes alternate angular opening and closing movements of the leaf towards and from an inside of the vehicle, respectively, a second end (2*b*) of the lever (2) being articulately joined to a first sector of an upper edge (6) of the leaf (1);

a horizontal guide (3), located above the upper edge (6) of the leaf, through which a carriage (4) slides in a rectilinear and alternate back-and-forth movement for closing and opening the leaf, said guide (3) being integral to a longitudinal support (7) mounted in a lintel of the housing compartment for the door provided in a body of the vehicle; and push-pull means (10,11) comprising an articulated joint that links a second sector of the upper edge (6) to the carriage (4), arranged such that when the leaf (1) rotates between two end resting positions that correspond to opening and closing positions of the leaf, due to the effect of the lever (2), said push-pull means (10,11)

forces said second sector of the upper edge (6) of the leaf (1) to move in a guided path during the opening and closing of the leaf, the lever (2) and push-pull means (10,11) being arranged such that when the leaf (1) is in the end opening position, a vertical plane that makes up the leaf (1) is substantially perpendicular to a vertical plane that defines the housing compartment for the door the system further comprising actuation means (12) simultaneously linked to the lever (2) and the carriage (4), which are adapted to distribute action on the lever (2) and the carriage (4) depending on a force required to open and close the leaf (1), such that the actuation means (12) are adapted to act on the carriage (4) during the opening and closing of the leaf (1), automatically distributing action on the lever (2) when additional power is required to move the carriage (4), during an initial opening operation of the leaf (1) from the end closing position, and during the closing and locking operation of the leaf (1) from an imminent closing position; and wherein the actuation means comprises an electric motor (12) coupled to said longitudinal support (7), a rotor (12*a*) and a stator (12*b*) of which are arranged to be able to rotate mutually with each other; the rotor (12*a*) coupled to a first transmission mechanism (13) that promotes the alternate back-and-forth movement of the carriage (4) to open and close the leaf (1) while the lever (2) is driven; and the stator (12*b*) coupled to a second transmission mechanism (18) that promotes rotation of the lever (2) while the carriage (4) is driven, such that the stator (12*b*) rotates when the rotor (12*a*) brakes and is not able to transmit to the carriage (4) the force required to lock or unlock the leaf (1) in the closing position.

2. The system for closing and opening, according to claim 1, wherein the motor (12) is fastened to the longitudinal support (7) in an area close to a main side edge (8) of the leaf (1) that is opposite the first end (2*a*) of the lever (2).

3. The system for closing and opening, according to claim 1, wherein said first mechanism (13) comprises a transmission belt (14) coupled to the carriage (4) and mounted in a closed loop around a driving pulley (15) that rotates jointly with a shaft of the rotor (12*a*) and a set of driven pulleys (16, 17) that are integral to said longitudinal support (7), such that the transmission belt (14) defines a rectilinear path for the movement of the carriage (4) on the horizontal guide (3) forming the alternate back-and-forth movement to open or close the leaf (1) depending on the rotation direction of the rotor (12*a*).

4. The system for closing and opening, according to claim 3, wherein the set of driven pulleys comprises two pulleys (16) arranged one at each of opposite ends corresponding to a start and an end of the path of the carriage (4), and at least one idler pulley (17) that, in combination with the driving pulley (15), enables the transmission belt (14) to be arranged in two substantially parallel branches, the carriage (4) being coupled to one of said two branches.

5. The system for closing and opening, according to claim 1, wherein said second transmission mechanism (18) is a crankshaft-rod mechanism comprising a rotating platform (19) that rotates jointly with the stator (12*b*), and a transmission connecting rod (20) articulately joined by a first end (20*a*) to an eccentric point of the rotating platform (19) and by a second end (20*b*) thereof to a first end of a thrust arm (21), said thrust arm (21) in turn being articulately joined at a second end thereof to the first end (2*a*) of the lever (2) that pivots about a point fixed to the vehicle, to open or close the leaf depending on the rotation direction of the stator (2*b*).

6. The system for closing and opening, according to claim 5, wherein in the closing position of the leaf (1), two articulation shafts at the first and second ends (20*a*,20*b*) of the connecting rod (20) are arranged diametrically opposite one another with respect to a rotation shaft of the stator (12*b*), such that an imaginary line (L) that joins the shafts of the first and second ends (20*a*,20*b*) of the connecting rod (20) is out of phase at a predetermined distance (d) with respect to the position of said rotation shaft of the stator (12*b*).

7. The system for closing and opening, according to claim 6, wherein the two articulation shafts of the connecting rod (20) are arranged diametrically opposite one another with respect to the rotation shaft of the stator (12*b*) with the articulation shaft of the first end (20*a*) of the connecting rod (20) arranged in a position that extends beyond the rotation shaft of the stator (12*b*).

8. The system for closing and opening, according to claim 1, wherein the motor (12) is mounted such that the rotor (12*a*) projects from the lower portion of the longitudinal support (7), on a surface of which there is the horizontal guide (3) of the carriage (4), and such that the stator (12*b*) projects from the upper portion of the longitudinal support (7).

9. The system for closing and opening, according to claim 1, wherein the first rotation end (2*a*) of the lever (2) is securely attached to a substantially vertical bar (5) that rotates about an axial shaft thereof and an upper end and a lower end of which are fixed to the vehicle.

10. The system for closing and opening, according to claim 1, wherein the push-pull means comprise an arm (10) securely joined by an end to the second sector of the upper edge (6) of the leaf (1), and articulately joined at the other end thereof to a vertical rod (11) integral to the carriage (4), about which it may rotate.

11. The system for closing and opening, according to claim 1, wherein the horizontal guide (3) is made up of an open transverse cross section profile defining a groove (3*a*), and the carriage (4) comprises at least one caster (4*a*) with a vertical shaft that circulates inside said groove (3*a*).

* * * * *